US006415987B2

(12) United States Patent
Vincent et al.

(10) Patent No.: US 6,415,987 B2
(45) Date of Patent: Jul. 9, 2002

(54) METHOD FOR COLLECTING LIQUID SPILLAGE AT RAIL FACILITIES

(75) Inventors: Jon R. Vincent, Lake Charles; Richard C. Gaudet, Sulphur, both of LA (US)

(73) Assignee: Century Group L.L.C., Sulphur, LA (US)

( * ) Notice: Subject to any disclaimer, the term of this patent is extended or adjusted under 35 U.S.C. 154(b) by 0 days.

(21) Appl. No.: 09/906,197

(22) Filed: Jul. 16, 2001

Related U.S. Application Data

(60) Division of application No. 09/440,912, filed on Nov. 16, 1999, now Pat. No. 6,290,143, which is a continuation-in-part of application No. 09/059,748, filed on Apr. 14, 1998, now abandoned, which is a continuation-in-part of application No. 08/643,014, filed on May 2, 1996, now Pat. No. 5,782,405.

(51) Int. Cl.[7] ..... B65D 1/00
(52) U.S. Cl. ..... 238/2; 220/573
(58) Field of Search ..... 238/2–9; 104/133; 220/571, 573; 137/312, 313; 141/86, 88, 98; 184/106

(56) References Cited

U.S. PATENT DOCUMENTS

| | | | | |
|---|---|---|---|---|
| 1,408,134 A | | 2/1922 | O'Donnell | |
| 3,773,255 A | | 11/1973 | Schoulties et al. | 238/2 |
| 4,010,896 A | | 3/1977 | Stockton | 238/2 |
| 4,296,884 A | | 10/1981 | Luebke | 238/2 |
| 4,299,697 A | | 11/1981 | Curati, Jr. | 210/532.1 |
| 4,300,721 A | | 11/1981 | Rich | 238/2 |
| 4,311,273 A | | 1/1982 | Marsh | 238/1 |
| 4,366,846 A | | 1/1983 | Curati, Jr. | 141/1 |
| 4,388,357 A | | 6/1983 | Luebke | 428/57 |
| 4,406,403 A | | 9/1983 | Luebke | 238/2 |
| 5,435,458 A | | 7/1995 | Bishop | 220/573 |
| 5,492,158 A | | 2/1996 | Haag | 141/98 |
| 5,782,405 A | | 7/1998 | Vincent | 238/2 |
| 5,975,332 A | * | 11/1999 | Bishop | 220/571 |
| 6,173,856 B1 | * | 1/2001 | Bierce et al. | 220/573 |

FOREIGN PATENT DOCUMENTS

| | | |
|---|---|---|
| DE | 4008747 | 9/1991 |
| DE | 0539349 | 10/1992 |
| DE | 0781886 | 12/1996 |
| US | 0952253 | 10/1999 |

* cited by examiner

*Primary Examiner*—Mark T. Le
(74) *Attorney, Agent, or Firm*—Bracewell & Patterson, L.L.P.

(57) ABSTRACT

A method for collecting liquid spillage at rail facilities using a structure that may include a plurality of center pans (10) and side pans (14) arranged in end to end relation. The pans (10, 14) are formed of a plastic material, preferably high density polyethylene. Each pan (10, 14) has a vertical drain pipe (54, 78) which fits within an elastomeric sleeve (60) about an upper drain opening (34) in a transverse drain conduit (28) positioned between a pair of crossties beneath the pans (10, 14). Each center pan (10) has a resilient upwardly inclined side flange or lip (44). For installation, the center pan (10) is preferably installed by first inserting one resilient side flange (44) beneath the head (16) of an adjacent rail (12) and then lowering the bottom (40) of the pan (10) onto the upper surface of the crossties (24) with drain pipe (54) received in sealing relation within the aligned elastomeric seal (60). Then, the opposed side flange (44) supported on the upper surface of the head (16) is forced or pushed downwardly beneath the head (16) where it snaps into sealing relation generally at the juncture of the vertical web (18) and the head (16) of the rail (12). Removable covers 90, 104, and 90A, are for covering center pans (10) and side pans (14).

6 Claims, 6 Drawing Sheets

METHOD FOR COLLECTING LIQUID SPILLAGE AT RAIL FACILITIES

This application is a divisional application of U.S. application Ser. No. 09/440,912 filed Nov. 16, 1999, now U.S. Pat. No. 6,290,143, entitled "Apparatus and Method for Collecting Liquid at Rail Road Facilities"; which is a continuation in part of application Ser. No. 09/059,748 filed Apr. 14, 1998, abandoned, entitled "Flexible Center Drain Pan For Railroad Track"; which is a continuation in part of application Ser. No. 08/643,014 filed May 2, 1996 entitled "Railroad Track Collector Pan System", now U.S. Pat. No. 5,782,405 dated Jul. 21, 1998.

BACKGROUND OF THE INVENTION

1. Field of the Invention

This invention relates to a system for collecting liquid spillage inadvertently spilled along a railroad track primarily from the filling or emptying of railway tank cars or the fueling of locomotives.

2. Description of the Related Art

The system includes a plurality of center pans and side pans supported on the crossties of the railway track for the draining of any liquid spillage from the pans into an enclosed transverse drain conduit positioned between a pair of crossties beneath the rails for flow into a collection container. Heretofore, a pan collection structure for a railway track has been provided utilizing center pans between the rails and side pans outside the rails. The pans heretofore have been supported on crossties and drain into a transverse drain conduit positioned between a pair of crossties beneath the pans.

For example, U.S. Pat. No. 4,300,721 dated Nov. 17, 1981 shows a system for collecting liquid spillage having a plurality of center pans and side pans. Vertical drain conduits extend from the pans into an enclosed transverse drain conduit for drainage. The transverse drain conduit empties into a collection receptacle. While the pans are formed of a molded plastic material, separate vertical drains are connected to the bottom of the pans. Further, while side edges of the pans are positioned adjacent the vertical web of the rails, a separate caulking material is used to provide sealing against the rails. The rigid vertical drain conduits are threaded into openings in the pans and in the enclosed transverse drain conduit.

U.S. Pat. No. 5,435,458 dated Jul. 25, 1995 shows a spill containment device for railroads in which slidable covers are positioned over center pans for closing the center pans when not required to be open to contain a potential spill. Foldable hinged panels are utilized for closing the outer field pans.

It is desired that a closed system for the collection of liquid spillage on a railroad track be provided that may be installed in a minimum of time with sealing against the rails.

SUMMARY OF THE INVENTION

The present invention is directed to a system for collecting spillage on a railway track including the apparatus or structure positioned on the crossties beneath railway cars and the method for installing such a collection structure between the rails and outwardly of the rails. The collection structure includes a plurality of center and side pans molded to shape from a resilient plastic material, such as high density polyethylene. The resilient center pans between rails have a pair of upwardly extending inclined side flanges which fit beneath the heads of the rails in sealing relation with the rails without any additional sealing members. A downwardly extending tubular drain pipe is molded onto each pan and fits within an enclosed transverse drain conduit positioned between a pair of crossties beneath the rails. The transverse drain conduit has an upper opening receiving each vertical drain pipe and a resilient annular seal about the upper opening receives the vertical drain pipe to provide a resilient sealing relation and to position the pans accurately.

The outer ends of the pans in one transverse row have outwardly extending end flanges which lap end flanges on an adjacent transverse row of pans arranged in end to end relation. Fasteners connect the lapping end flanges of adjacent transverse rows together to permit limited relative longitudinal movement which may result from temperature expansion or contraction, for example.

The pans forming this invention may be installed and assembled in a minimum of time. A preferred assembly method includes the insertion of center pans between the rails with one resilient side flange positioned beneath the rail against the vertical web of the rail under the head of the rail with the pan being inclined upwardly from the rail. The inclined pan is then pivoted downwardly with the bottom of the center pan resting against the crossties and the opposite resilient side flange in contact relation with the upper surface of the rail. Next, the opposite resilient side flange is forced by a suitable tool downwardly beneath the head of the rail where it snaps outwardly against the vertical web of the rail in sealing relation thereto. A downwardly extending integral drain pipe molded on each of the pans is vertically aligned with the lower receiving opening in the transverse drain conduit for initial to positioning of the center pan accurately with the transverse drain conduit. An annular resilient seal is positioned within the opening of the drain conduit to receive the vertical drain pipe in sealing relation.

In some instances, it may be desirable to position the center pan on the crossties with the bottom of the center pan supported on the crossties and both of the resilient side flanges in engagement with the upper surface of the rails. Then, each of the resilient side flanges may be forced or pushed beneath the head of the adjacent rail for snapping beneath the head of the adjacent rail in sealing relation with the vertical web of the rail.

Each of the side pans has a resilient side flange in sealing relation with the vertical web of the adjacent rail. Fasteners are provided to secure the side pans to the crossties and to permit limited expansion and contraction thereof. Ballast on an outwardly extending lower flange or foot of the side flange assists in maintaining the side pan in sealing relation against the rail.

One embodiment of the invention provides removable covers for closing the center and field pans when the pans are not required to be open to contain a potential spill. The center cover has opposed side flanges which provide longitudinal flow channels and also fit beneath the heads of the adjacent rails. Another embodiment of the invention provides removable covers for pans including side flanges which provide longitudinal flow channels and have spouts for the drainage of fluids from the flow channels. Slidable covers without spouts are also provided for opening of the pans.

Other features and advantages of the invention will be apparent from the following specification and drawings.

DETAILED DESCRIPTION OF THE INVENTION

Figure 1:
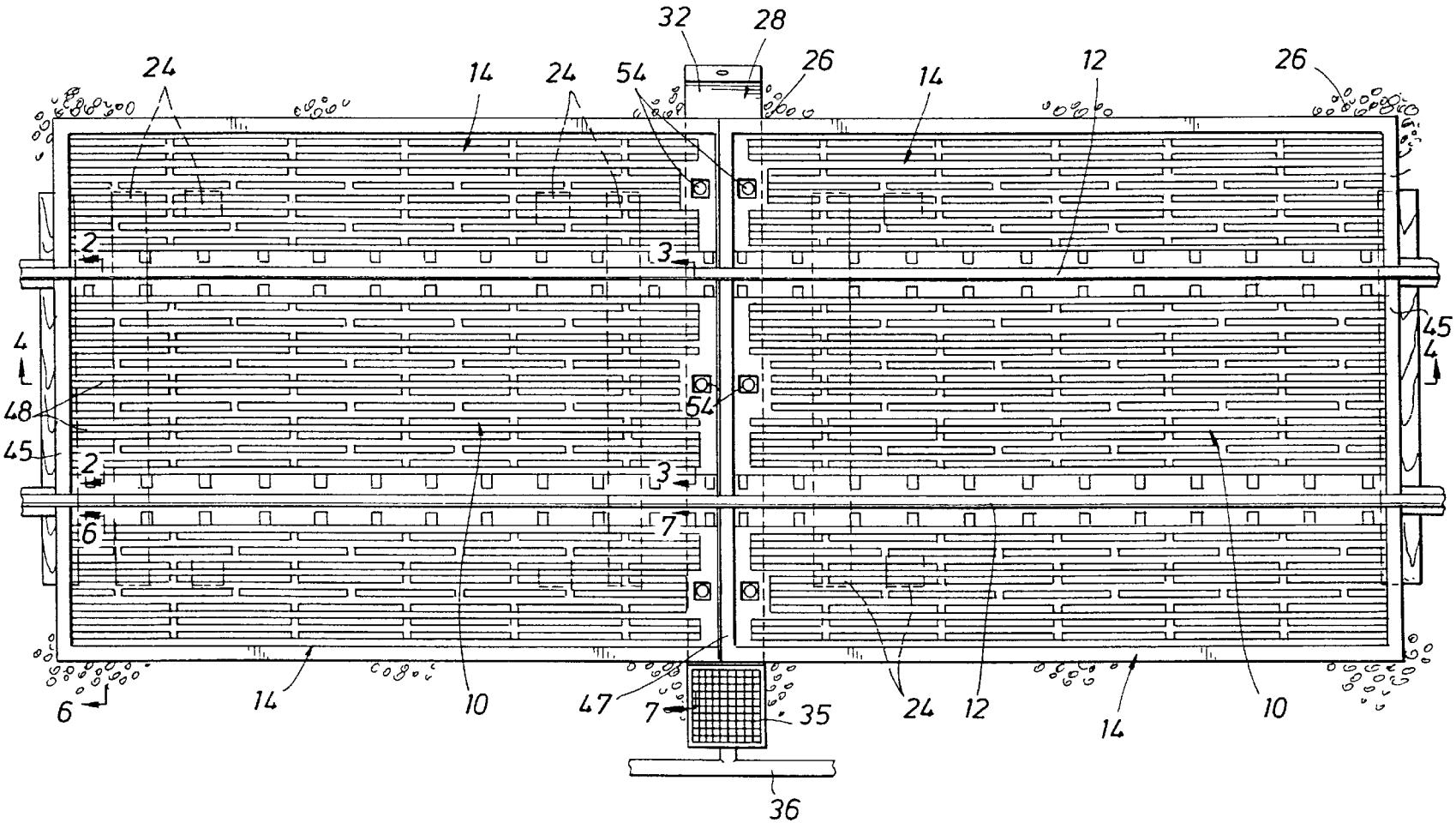
FIG. 1 is a plan view of a pan system including two rows of molded plastic pans in accordance with the present invention positioned on a railway track for collecting spillage from tank cars and locomotives, each row including a center pan between the rails and a pair of side pans outside the rails.

The present invention is directed to a pan system for collecting liquid spillage on a railroad track. As shown particularly in FIG. 1, two adjacent transverse rows of drain pans are shown including a pair of center pans generally indicated at 10 arranged in an end to end relation between rails 12 of the railroad track and a pair of side pans generally indicated at 14 arranged in end to end relation along the outer side of each rail 12. Each rail 12 as shown particularly in FIGS. 2 and 3 includes an upper head or ball 16, a vertical web 18, and a lower base 20. Lower base 20 is mounted on tie plates 22 supported on crossties 24. Crossties 24 are mounted on ballast 26 normally comprising crushed rock.

Figure 5:
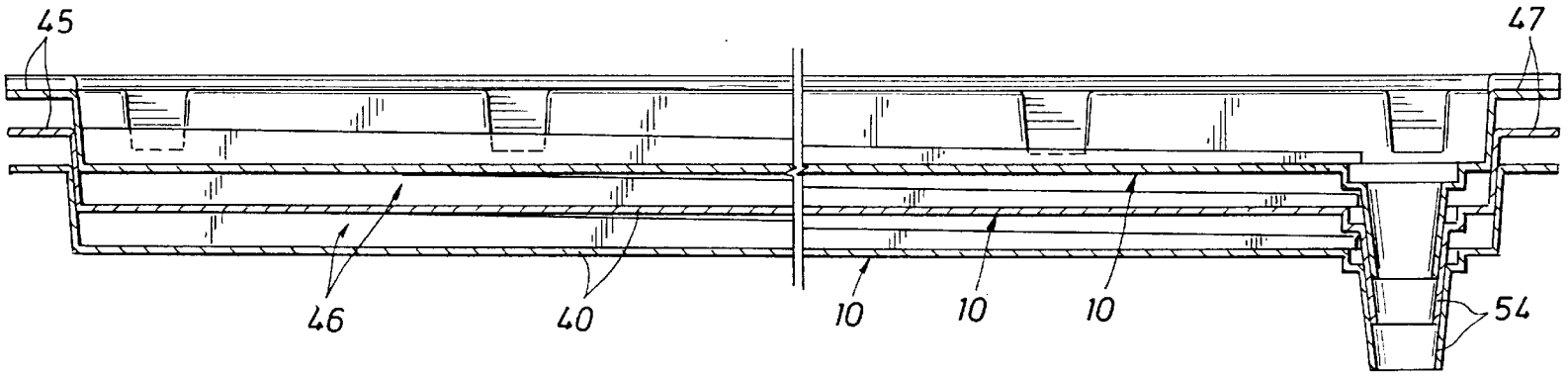
FIG. 5 is a longitudinal sectional view of a plurality of center pans shown in a vertically stacked relation for storage or transport.

Pans 10 and 14 are formed of a molded lightweight plastic material, preferably high density polyethylene, having a thickness of preferably about'/4 inch to provide flexibility and resilience. Pans 10 and 14 formed of a lightweight material may be easily stacked vertically for storage or transport prior to installation on a railroad track such as shown in FIG. 5 for center pans 10. Also, relatively long length pans such as fifteen (15) feet in length, function in a satisfactory manner. Thus, each row shown in FIG. 1 may have a length of fifteen (15) feet.

Figure 3:
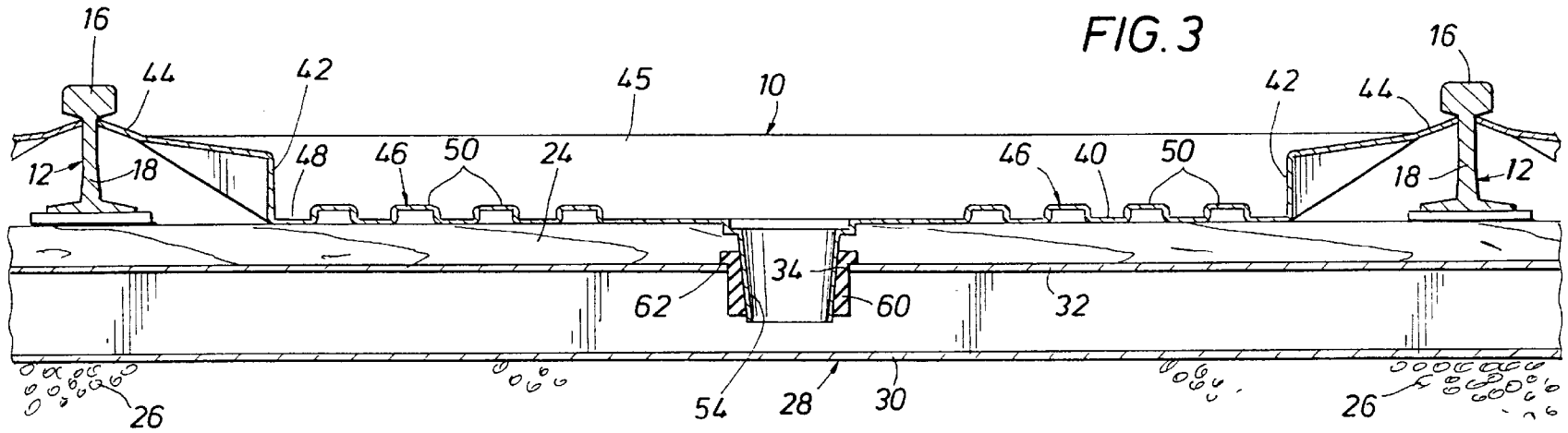
FIG. 3 is a transverse sectional view taken generally along line 3—3 of FIG. 1 and showing an opposite end of the center pan shown in FIG. 2 with a vertical drain pipe received within a transverse drain conduit.
Figure 4:
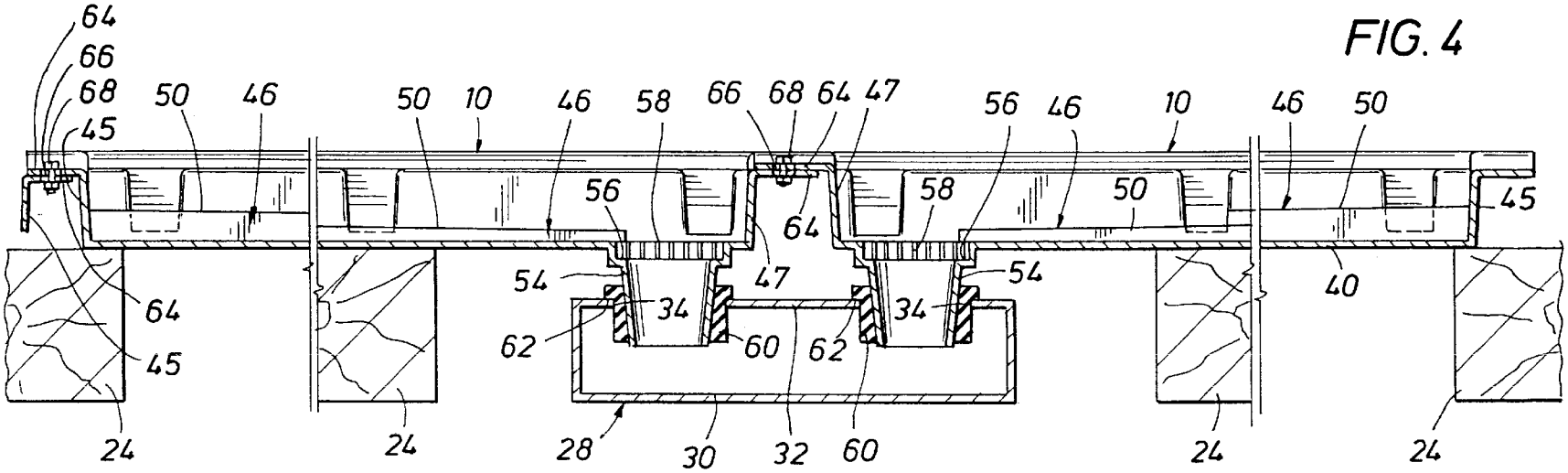
FIG. 4 is an enlarged longitudinal sectional view taken generally along line 4—4 of FIG. 1 and showing a pair of center pans connected in end to end lapping relation and having integral molded drain pipes extending downwardly from the bottom of the center pans into a transverse drain conduit, the intermediate portion of each pan being omitted.
Figure 7:
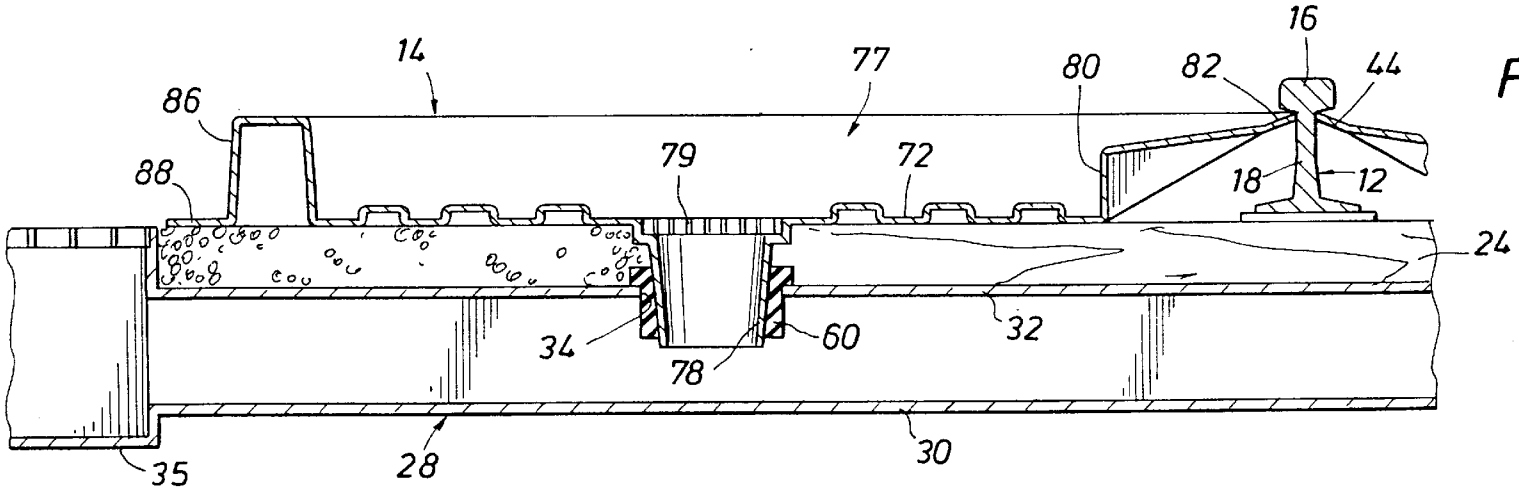
FIG. 7 is a section taken generally along line 7—7 of FIG. 1 and shows the lower drain end of the end panel shown in FIG. 6.

For the collection of liquid spillage from pans 10 and 14, an enclosed transverse drain conduit generally indicated at 28 in FIGS. 3, 4, and 7 is positioned between a pair of crossties 24 beneath the drainage end of pans 10 and 14 to receive the liquid spillage from pans 10 and 14. Conduit 28 is of a rectangular cross section having a sloping lower wall 30 and an upper wall 32. Upper wall 32 has an opening 34 for each of pans 10 and 14 to receive the liquid spillage from pans 10 and 14. The extending lower sloping end of transverse drain conduit 28 is connected to a catch basin 35 having a longitudinal drain pipe 36 which extends to a collection facility or container (not shown). If desired, catch basin 35 may be omitted with drain pipe 36 connected directly to an end of drain conduit 28.

Figure 2:
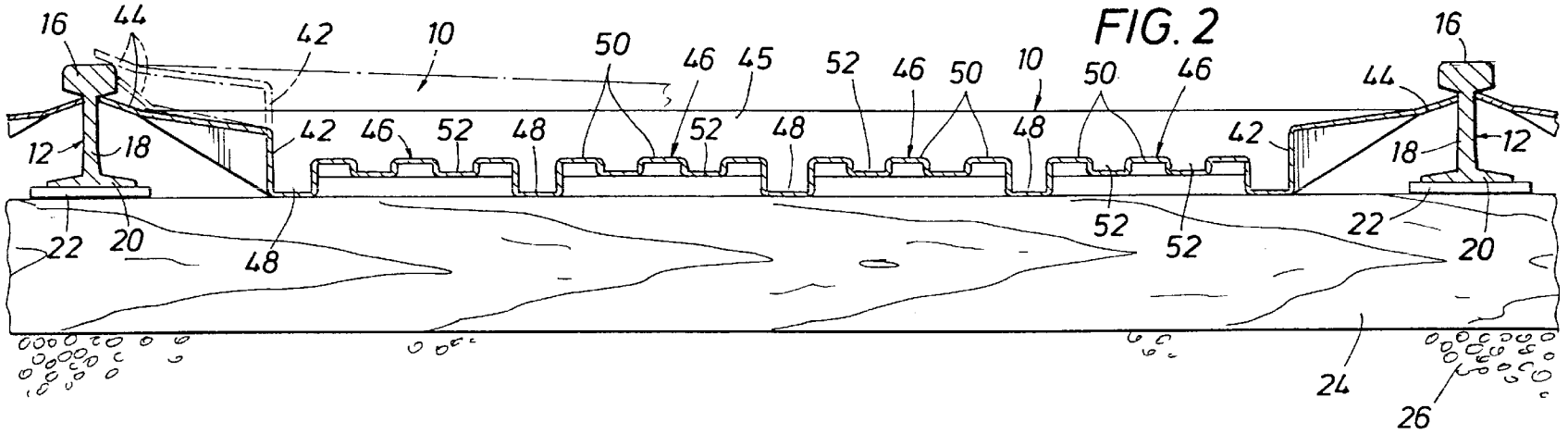
FIG. 2 is a transverse sectional view taken generally along line 2—2 of FIG. 1 and showing one end of a molded center plastic pan installed on the railroad track between the rails.

Each center pan 10 of a molded plastic construction is resilient and includes a bottom 40, a pair of opposed sides 42, and a flexible resilient upper side flange or lip 44 extending laterally outwardly from each side 42. Pan bottom 40 is supported on the upper surface of crossties 24 and has a plurality of molded ribs to provide flow channels for pan 10 and to reinforce pan 10. As shown particularly in FIGS. 2–4, raised rib sections 46 at the upper end 45 of center pan 10 as shown in FIG. 2 slope downwardly to the lower opposed end 47 of pan 10 for the drainage of liquid from upper end 45 to lower end 47. Main flow channels 48 along bottom 40 are provided adjacent raised rib sections 46. Rib sections 46 have ribs or corrugations 50 defining shallow flow channels 52 therebetween. Rib sections 46 for pan 10 having a length of fifteen (15) feet have a slope of between about one (1) and two (2) inches from upper end 45 to lower end 47. Flow channels 48 as shown in FIG. 2 adjacent upper end 45 are deep and are shallow adjacent lower end 47 as shown in FIG. 3. Thus, the depth of flow channels 48 progressively decreases from end 45 to end 47. Flow channels 52 remain at a constant depth between ends 45 and 47. Flow channels 48 and 52 are effective in the drainage of solid particles, such as sand, from pan 10. As shown in FIG. 4, each molded center pan 10 has an integral downwardly extending drain pipe 54 defining an inset annular shoulder 56 to receive in supporting relation a metal grate 58. Drain pipe 54-tapers in a downward direction and is flexible to facilitate fitting within a vertically aligned opening 34 in transverse drain conduit 28.

To provide a fluid tight fitting between vertical drain pipe or tube 54 and transverse drain conduit 28, an elastomeric sealing sleeve 60 is mounted within opening 34 to receive in sealing relation the lower end of vertical drain pipe 54. Sleeve 60 has an annular shoulder 62 that fits about opening 34 and contacts in sealing relation the upper surface of to upper wall 32 of transverse drain conduit 28. The resilience of sleeve 60 and tapered drain pipe 54 provide an effective sealing relation.

Referring now to FIGS. 2 and 3, in the installed position, resilient side flanges or lips 44 are positioned in sealing relation against vertical web 18 beneath head 16 of the adjacent rail 12 generally at the juncture of vertical web 18 with head 16. No additional separate sealing elements are required between center pan 10 and rails 12. As shown in FIG. 4, each end 45, 47 has an extending upper end flange 64 which laps an adjacent flange 64 of an adjacent center pan 10. Aligned elongate slots 66 are provided in lapping flanges 64 and fasteners 68 having resilient washers fit within aligned slots 66 and are tightened to hold flanges 64 together at ends 45 and 47. Slots 66 permit limited temperature expansion and contraction of adjacent center pans 10 of about one (1) inch.

Center pans 10 may be easily installed between rails 12 in a minimum of time. Transverse drain conduit 28 with sleeves 60 within openings 34 is positioned between a pair of crossties 24 with one crosstie 24 removed to provide adequate space for transverse drain conduit 28. A preferred installation method as shown partially in FIG. 2 in broken lines comprises the positioning of one resilient side flange 44 beneath the head 16 of an adjacent rail 12 with pan 10 inclined upwardly at about a thirty (30) degree angle to the adjacent rail 12. Vertical drain pipe 54 is initially aligned vertically with an associated opening 34 and sealing sleeve 60. Then, the center pan 10 is pushed downwardly with the bottom 40 of pan 10 supported on the upper surface of the crossties 24 and pipe 54 received within resilient sleeve 60 in sealing relation, as shown in FIGS. 2 and 3. In this position, the opposed resilient side flange 44 is in contact with the upper surface of head 16 of the other rail 12 as shown in broken lines in FIG. 2 and is forced upwardly by the upper surface of head 16. Next, the opposed resilient side flange 44 is forced downwardly past head 16 by a workman with a suitable tool where it snaps outwardly into sealing engagement with vertical web 18 generally at the juncture of vertical web 18 with head 16. Elongate slots 66 in lapping end flanges 64 of adjacent center pans 10 as shown in FIG. 4 are aligned and fasteners 68, such as suitable nut and bolt combinations with resilient washers, are installed to connect adjacent center pans 10 together in end to end relation. Another method of installing center pan 10 comprises the aligning of drain pipe 54 with sleeve 60 and the pushing or forcing of center pan 10 downwardly onto crossties 24 between rails 12 without inclining center pan 10 so that both side flanges 44 contact the upper surface of adjacent heads 16 and are held thereon. Both resilient side flanges 44 may then be forced beneath heads 16 by a workman with a suitable tool for snapping of side flanges 44 into sealing position beneath heads 16.

Figure 6:
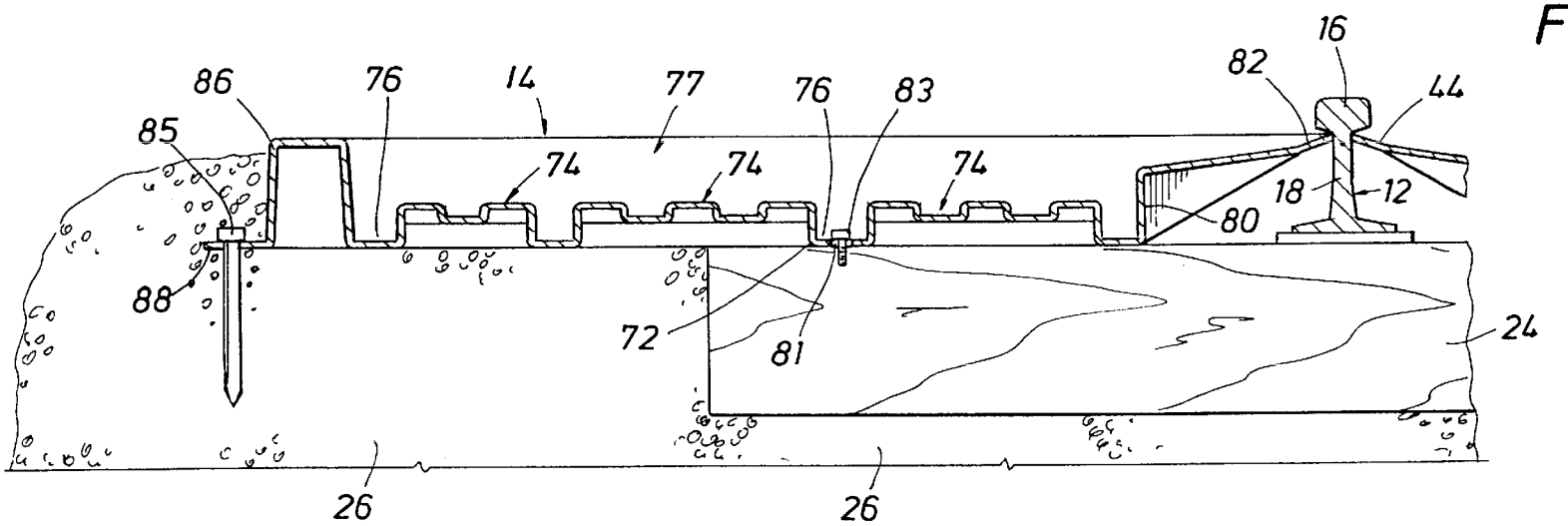
FIG. 6 is a section taken generally along line 6—6 of FIG. 1 and showing an upper end of a side panel.

Side pans 14 are shown in FIGS. 6 and 7. Each side pan 14 has a bottom 72 and raised rib sections 74. Main flow channels 76 are provided between raised rib sections 74 which slope downwardly from an upper end 77 shown in FIG. 6 to a lower end shown in FIG. 7. An integral drain tube or pipe 78 extends downwardly from bottom 72 for fitting within an elastomeric sealing sleeve 60 in a manner similar to outer pan 10. Grate 79 is supported on drain pipe 78.

An inner side 80 has an extending side flange 82 which fits beneath head 16 in sealing relation generally at the juncture of head 16 and vertical web 18. Drain tube or pipe 78 is positioned for urging side flange 82 into sealing relation with head 16 at the lower end of side pan 14 when drain pipe 78 is received within sealing sleeve 60. Also, bottom 72 has elongate slots 81 receiving lag screws 83 and washers which are secured to the crossties 24. An outer channel-shaped side 86 of side pan 14 has an extending lower flange 88 covered with ballast to assist in maintaining side pan 14 in sealing position against head 16 of the adjacent rail 12.

Each side pan 14 has an upper end flange at each end thereof which is adapted to be positioned and secured in lapping relation to a mating end flange on an adjacent side pan 14 in a manner similar to lapping flanges 64 secured by fasteners 68 as shown in FIG. 4 for center pan 10. Side pans 14 are arranged in transversely aligned position with center panel 10. For installation, resilient side flange 82 is pushed manually tightly against the junction of head 16 and vertical web 18 of adjacent rail 12 with drain pipe 78 aligned vertically with seal 60. Then, downwardly extending drain pipe 78 is lowered within elastomeric sealing sleeve 60 in transverse drain conduit 28. Ballast is then positioned over extending flange 88 and lag screws 83 with washers are inserted in the crossties through suitable elongate slots 81 in bottom 72 of side pan 14. The lag screws 83 are received within a relatively small elongated slot so that limited expansion and contraction of side panel 14 less than about one (1) inch is provided. In some instances, lag screws 83 may be omitted. Spikes 85 are provided for flange 88 and are of a length of about eight (8) inches for extending within ballast 26 for securement of side pans 14.

The arrangement of the rib sections in center panel 10 and side panel 14 provides longitudinal flow channels for the fluid and also solid particles carried by the fluid. Sand is oftentimes deposited into pans 10 and 14 and the arrangement of the longitudinally extending flow channels permits the sand to drain easily into the end drain tube. Heretofore, particularly for flat pans, sand has tended to deposit in various locations of the flat pans. The molded plastic pans 10 and 14 formed preferably of polyethylene provides a substantial resilience and flexibility. Vertical drain pipes which are molded with the pans fit within resilient sleeves in the transverse drain conduit and this permits the track to move relative to the transverse conduit. The limited flexure or movement of the drain pans relative to the transverse drain conduit is important since the operation of a train on the rails causes a vertical pumping action which may be transmitted to the drain pans and cause some movement of the drain pans. As a result of the elastomeric sleeves and the resilient drain pipes received therein, movement of the drain pans and the track is not transmitted to the enclosed lower transverse drain conduit and a substantially liquid tight seal is maintained between the pans and the rails as well as the transverse drain conduit. While the drain conduit has been illustrated in the drawings as positioned at an end of the drain pans, it is apparent that the downward extending drain tube or pipe may be positioned at other locations such as the center of the drain pan, for example. Further, in some instances, it may be desirable to have a single transverse drain conduit for each row of pans. As the plastic material from which the pans are molded, such as high density polyethylene, may be of a thickness of around % 4 inch, the drain pans may be of a relatively long length, such as fifteen (15) feet in length and yet be lightweight. This would permit the easy stacking of vertical pans and side pans for shipment or for storage. Other moldable materials may be suitable for the drain pans such as fiberglass.

Where a single transverse drain conduit is utilized for adjacent transverse pairs of side and center pans arranged in end to end relation as shown in the drawings, it may be desirable to remove a crosstie to permit a relatively wide transverse drain conduit to fit beneath the pans between a pair of adjacent crossties. It is desirable that the pans for installation and transport not be undesirably flexible and the ribbed construction provides reinforcement against bending or flexure particularly in a transverse direction. Likewise, the ends and sidewalls of the pans provide resistance against undue bending or flexure of the pans.

Figure 8:
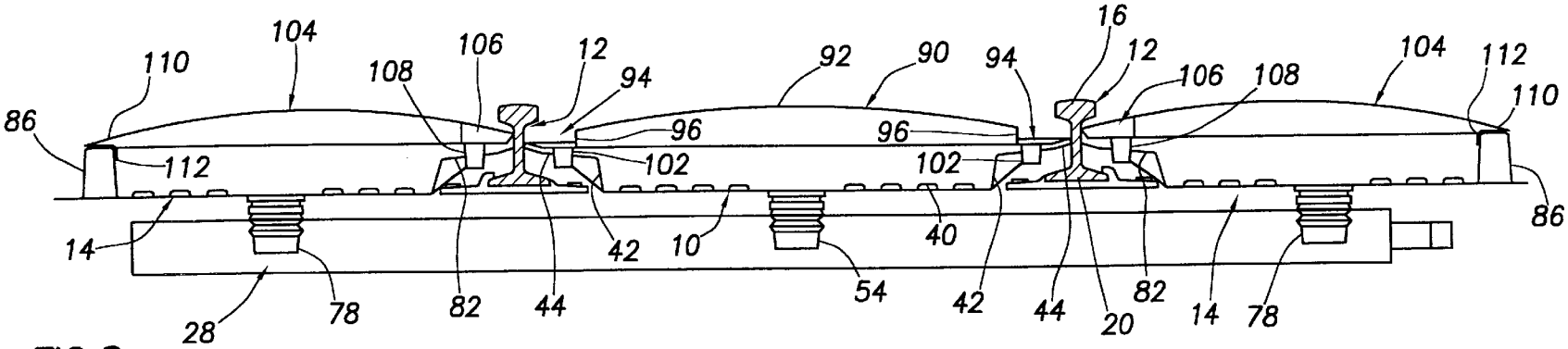
FIG. 8 is a cross sectional view of another embodiment in which removable resilient covers are positioned over the side and center pans with drain spouts in side flanges of the covers extending through aligned openings in the pans for drainage into the ballast.
Figure 9:
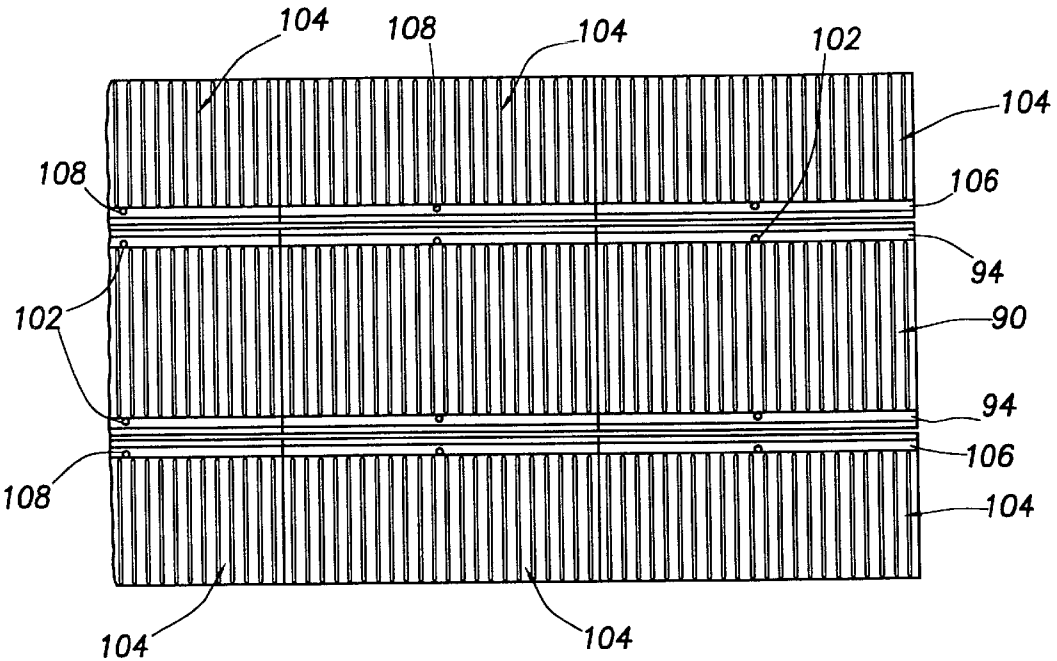
FIG. 9 is a top plan view of the embodiment shown in FIG. 8.
Figure 10:
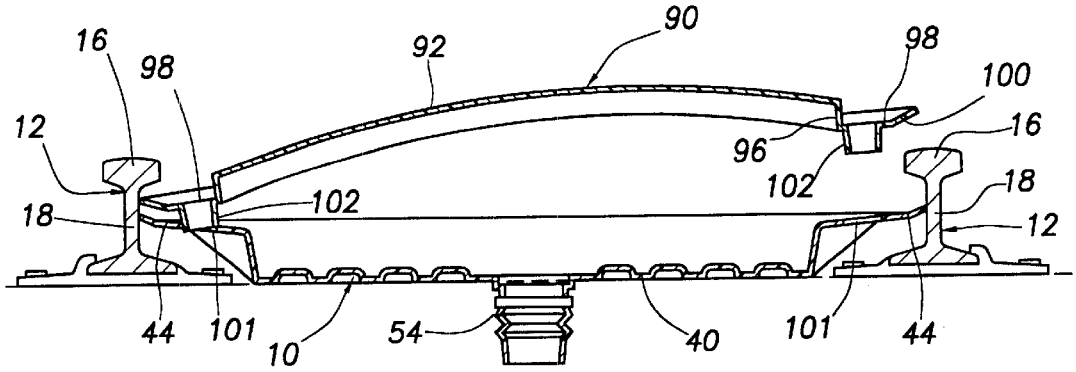
FIG. 10 is a sectional view illustrating installation of the cover for the center pans.

An embodiment shown in FIGS. 8–10 is directed to a removable cover or lid generally indicated at 90 for fitting over lower center pan 10. Center pan 10 is identical to center pan 10 in the embodiment of FIGS. 1–7 to include a bottom 40, a pair of opposed sides 42 and a flexible resilient upper side flange or lip 44 extending laterally outwardly from each side 42. For installation of center pan 10, one side flange 44 is preferably positioned beneath head 16 of one rail 12 and the other opposed side flange 44 is forced downwardly past head 16 of the other rail 12 snapping beneath head 16 against vertical web 18.

Center cover or lid 90 has an upper arcuate body 92 and a trough generally indicated at 94 along each side thereof defining a fluid flow passage. Trough 94 is defined by a downwardly extending generally vertical side 96, a bottom 98, and an upwardly extending outer flange 100 inclined outwardly for fitting beneath head 16 of rail 12. Bottom 98 contacts and is supported on side flange 44 of center pan 10.

A drain spout 102 extends downwardly from bottom 98 and is mounted at a location about 'h the length of trough 94. Trough 94 slopes downwardly from each end of cover 90 to spout 102. Side flange 44 of the subjacent center pan 10 has an opening 101 to receive spout 102. Adjacent lids or covers 10 are arranged in end to end relation and may have mating lapping end flanges for minimizing liquid drainage thereat into the lower closed center pan 10.

Rain water drains from opposed ends of cover 90 downwardly to spouts 102 for discharge through lower flange 44 into the ballast between the crossties. Since covers 90 are formed of a resilient material, such as high density polyethylene, lids 90 may be removed from center pan 10 by forcing flange 100 on one trough 34 inwardly for clearing head 16 of rail 12 thereby permitting the removal of covers 92 so that access to center pan 10 is provided as is desired for loading and unloading railway tank cars and fueling locomotives on rails 12 over center pans 10. Rain water easily flows along troughs 90 for discharge from spouts 102 into the ballast adjacent the ends of troughs 90.

Side pans 14 are shown in FIGS. 8 and 9 and side covers 104 are shown for side pans 14. Side pans 14 have channel-shaped sides 86 and side flanges 82. Covers 104 have a trough 106 on one side adjacent rail 12 with a spout 108 extending downwardly therefrom. The other side 110 is supported on channel 86. A lip 112 fits against the side of channel-shaped side 86 to urge inner side flanges of covers 104 into engagement with adjacent rail 12. Drain pipes 78 on outer pans 14 and drain pipe 54 on center pan 10 extend within transverse drain conduit 28.

Figure 11:
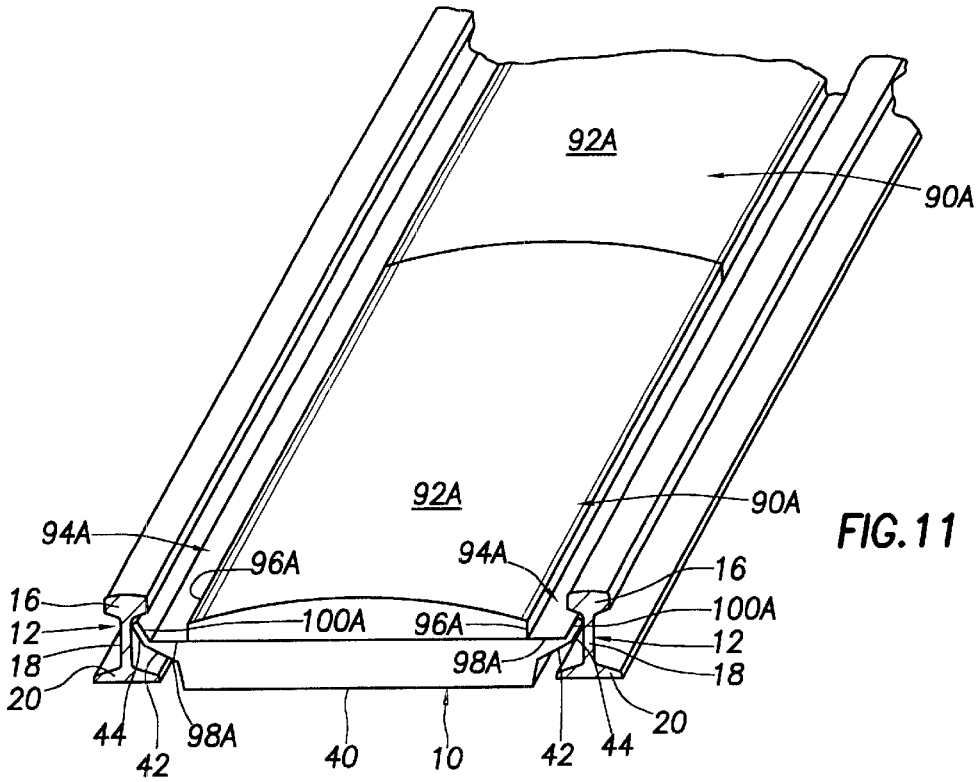
FIG. 11 is a perspective of another embodiment in which a removable cover without spouts is positioned over the center pan and provides a flow channel along each side of the cover for fluid flow into the ballast, the cover being mounted for sliding movement for opening the lower center pan.

A modified lid or cover 90A is shown in FIG. 11 for fitting over a subjacent center pan 10. Cover 90A has an upper arcuate body 92A and a trough generally indicated at 94A along each side thereof to form a fluid flow passage. Trough 94A has an inner side 96A, a bottom 98A, and an upwardly extending outer flange 100A inclined outwardly for fitting beneath head 16 of rail 12. To open center pans 10, particularly for loading and unloading tank cars or fueling locomotives, covers 90A may be removed from center pan 10 by sliding along flanges 44 of center pan 10. Covers 90A may be positioned on the crossties after removal from pans 10 to permit drainage from railway cars or locomotives directly into center pans 10. If desired, lids 90A may be removed by forcing lips 100A from beneath head 10 of rail 12 since cover 90A is formed of a resilient material such as high density polyethylene. Sides 94A are provided with a desired slope for adequate drainage of fluids along troughs 94A. Handles may be provided on covers 90A, if desired, to assist in installation and removal of covers 90A.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

We claim:

1. A method for installing a resilient center pan having a pair of upwardly extending resilient side flanges beneath the heads of a pair of parallel rails supported on crossties of a railway track for mounting the center pan; said method comprising the following steps:

inserting one side flange of the center pan beneath the head of one of the rails;

pivoting the center pan downwardly against the crossties generally about said one side flange for supporting the bottom of the pan on the crossties with the other resilient side flange extending over and supported on the head of the other rail; and then forcing said other resilient side flange beneath the head of the other rail for installation of the center pan.

2. A method for installing a resilient center pan having a pair of upwardly and laterally extending side flanges beneath the heads of a pair of parallel rails supported on crossties of a railway track; said method comprising the following steps:

positioning the center pan on the crossties between the rails with the resilient side flanges extending above and supported on the upper surface of the heads of said rails; and forcing the resilient side flanges beneath the heads of the rails with the side flanges snapping into an installed position beneath the heads of the rails in contact with the vertical webs thereof for mounting of the center pan.

3. A method for installing a resilient center pan having a tubular drain pipe extending downwardly from the bottom of the pan and a pair of parallel side flanges extending outwardly in an inclined relation to the bottom of the pan, the center pan arranged for installation between a pair of rails supported on crossties of a railway track and for draining into an enclosed transverse drain conduit positioned between a pair of crossties and having an upper opening to receive the tubular drain pipe of the center pan; said method comprising the following steps:

positioning the resilient center pan on the crossties of the railway track with the downwardly extending tubular drain pipe received within said upper opening of said enclosed transverse drain conduit; and snapping said resilient side flanges against the web of said rails beneath the heads thereof for installation of said center pan between the rails.

4. The method as set forth in claim 3 wherein the step of positioning the resilient side flanges beneath the heads of said rails includes first positioning one of said resilient side flanges beneath the head of one rail, then pivoting the center pan downwardly into supporting relation on the crossties; and then forcing the other resilient side flange beneath the head of the other rail for installation of the center pan.

5. The method as set forth in claim 3 wherein the resilient center pan has a laterally extending upper flange at each end of the center pan for lapping similar flanges on adjacent center pans in end to end relation; said method further including the step of connecting the lapping flanges of adjacent center pans to each other to permit limited relative longitudinal movement between adjacent center pans.

6. The method as set forth in claim 3 wherein a resilient annular sealing sleeve is positioned about said upper opening in said enclosed transverse drain conduit; said step of positioning the resilient center pan on the crossties of the railway track includes positioning said downwardly extending tubular drain pipe within said resilient sealing sleeve to provide a substantially fluid tight relation between said pan and said enclosed transverse drain conduit.

* * * * *